US006098561A

United States Patent [19]

Förthmann

[11] Patent Number: 6,098,561

[45] Date of Patent: Aug. 8, 2000

[54] SELF-STEERING SYSTEM FOR BOATS

[76] Inventor: Peter Förthmann, Bandwirkerstrasse 39-41, D-22041 Hamburg, Germany

[21] Appl. No.: 09/136,155

[22] Filed: Aug. 18, 1998

[30] Foreign Application Priority Data

Aug. 18, 1997 [DE] Germany ..... 297 14 603 U

[51] Int. Cl.[7] ..... B63H 25/04

[52] U.S. Cl. ..... 114/144 C

[58] Field of Search ..... 114/144 R, 144 C

[56] References Cited

U.S. PATENT DOCUMENTS 3,983,831 10/1976 Knoos et al. ..... 114/144 C
4,766,833 8/1988 Knoos ..... 114/144 C

FOREIGN PATENT DOCUMENTS 20243942 of 1987 European Pat. Off. .
8810315 U of 1988 Germany .

*Primary Examiner*—Ed L. Swinehart
*Attorney, Agent, or Firm*—Tarolli, Sundheim, Covell, Tummino & Szabo L.L.P.

[57] ABSTRACT

A steering system for a boat includes an auxiliary rudder which is rotatable to effect changes in course of the boat. A servo-pendulum rudder is rotatable by a positioning device. When the servo-pendulum rudder is rotated, it is pivotal transversely to a keel line of the boat by water flowing past the boat. A drive connection is provided between the servo-pendulum rudder and the auxiliary rudder. The drive connection includes a drive member and a driven member. One of the driving and driven members is pivotal between an engaged condition in which the drive connection is effective to transmit force between the pendulum rudder and the auxiliary rudder and disengaged condition in which the drive connection is ineffective to transmit force. The drive and driven members may be provided with teeth which are disposed in meshing engagement when the one of the driving and driven members is in the engaged condition.

20 Claims, 6 Drawing Sheets

SELF-STEERING SYSTEM FOR BOATS

BACKGROUND OF THE INVENTION

The present invention relates to a self-steering system for boats, in particular sailing boats.

Known, generic self-steering systems comprise four main elements, namely a positioning device (transducer), a servopendulum rudder, an auxiliary rudder and a disengageable drive connection between servo-pendulum rudder and auxiliary rudder. Course corrections are effected through said disengageable drive connection by the auxiliary rudder as a result of a pivoting motion of the servo-pendulum rudder, which is caused to perform a pendulum swing by the positioning device. The drive connection can be released using the clutch device. Specifically, such a self-steering system consists of a servo-pendulum rudder, which can be rotated by means of a positioning device such as a windvane or a compass-controlled servomotor when the boat deviates from a desired course and which as a result of the rotation can be pivoted out transversely to the keel line of the boat by water flowing past, an auxiliary rudder, which an be forcibly rotated about an approximately vertical axis of rotation as a result of a pivoting motion of the servo-pendulum rudder, can be flowed against by water flowing past and is used to generate course corrections, and also a clutch device for engaging and disengaging the drive connection between the servo-pendulum rudder and the auxiliary rudder.

Problems may be experienced with the drive connection due to possible extreme swings of the servo-pendulum rudder and/or possible high forces in a seaway. The clutch device itself, which is combined with the drive connection, also gives cause for concern for the same reasons. Prior solutions have thus failed to provide complete satisfaction.

In the self-steering system with servo-pendulum and auxiliary rudder known from EP-A2-243 942, the releasable drive connection comprises two levers carrying joint balls at their free ends and an intermediate Cardan-like lever, which accommodates the balls together and has a removable bearing surface for releasing one of the two balls, i.e. for disengaging the drive connection. This drive connection thus consists of two knuckle joints, active in the working position along two or three axes, which, although providing a relatively low-play drive connection, demand a certain agility during engaging and disengaging and also require a hand to be placed directly on the double-jointed connection during engaging and disengaging. This proximity of the hand to the moving parts entails a risk of injury. Furthermore, the joint sockets of the intermediate lever are subject to a not inconsiderable risk of breakage in the case of impulsive movements of the servo-pendulum rudder or of the auxiliary rudder.

In another known self-steering system with servo-pendulum rudder and additional auxiliary rudder based on G-U1-88 10 313.3, the releasable drive connection between servo-pendulum rudder and auxiliary rudder consists of a tiller for operating the auxiliary rudder, which tiller encloses a windvane mounting shaft in the manner of a frame, can pivot vertically and rests with a U shaped recess on a horizontally oriented finger, said finger protruding laterally from the upper end of the servo-pendulum rudder above the pendulum axle of the latter and thus transmitting the pendulum motion of the servo-pendulum rudder to the frame-like tiller of the auxiliary rudder. The force transmission finger moves along a circular path in the vertical plane, so the joint for vertically pivoting the auxiliary rudder tiller has to be very smooth running to follow every pendulum swing of the servo-pendulum rudder horizontally and vertically. Only thus can it be ensured that the frame-like tiller, also referred to as the driving yoke, always remains in positive-locking contact with the force transmission finger of the servo-pendulum rudder. Although such a drive connection offers a degree of remote operation and thus limits the risk of injury during engaging and disengaging, it also allows a not inconsiderable amount of mechanical play, which has a detrimental effect on responsiveness. Furthermore, the rudder travel is severely restricted by the frame construction of the tiller and the functional reliability when transmitting relatively high forces and/or relatively frequent pendulum movements gives cause for concern.

SUMMARY OF THE INVENTION

Against the background of this prior art the object of the present invention is to improve the handling and operational reliability of the clutch device. Moreover it is desired to accommodate the possible extreme loads on the drive connection in a more satisfactory manner.

The invention proposes a self-steering system with the features of claim 1 in solution of this object. Accordingly in a generic self-steering system (i) the drive connection between the servo-pendulum rudder and the auxiliary rudder comprises a toothed bevel gear or a similar joint-free angular drive connection and (ii) the drive member or, preferably, the driven member, of the clutch device is or becomes secured in place in both positions. The drive member or the driven member is preferably in the form of a rocker that can be pivoted about its rocker axis between the working position, that is to say the engaged state, and the resting position, that is to say the disengaged state.

The invention, in particular with a toothed bevel gear element (drive member or driven member) realized as a rocker, allows even large and impulsive forces to be transmitted operationally reliably almost without wear and with a precisely pre--definable margin for play, and at the same time also allows the operator to engage and disengage the self-steering system, even when the latter is fully loaded, without serious risk of injury. It thus even allows safe operation when, for example, the boat equipped with the self-steering system is making little way through a sloppy sea and the servo-pendulum rudder is subject to sudden lateral impulses which load the drive connection and generally also set it in motion. The self-steering system can likewise also be safely engaged and disengaged when the boat is making good way despite the high dynamic loads that occur at speed. This is of particular benefit when, for example, it becomes necessary to disengage in order to make a sudden avoiding maneuver.

A rocker according to the invention represents a particularly advantageous way of allowing the operator to keep the operating hand sufficiently far away from the actual drive connection when carrying out the engaging operation. A handle, such as an auxiliary steering tiller or the like, may for example by provided for carrying out the rocker movement. Moreover the rocker, i.e. the movable drive or driven member, can be secured in place particularly effectively, that is to say to quickly and with strength for force transmission, with simple means and without compromising the necessary margin for play.

Executing the joint-free drive connection as a bevel gear, as is particularly preferred, allows said drive connection to be free of slip, capable of withstanding high mechanical loads and also particularly free of wear. Since the lateral swings, i.e. pendulum swings, of the servo-pendulum rudder do not exceed approximately +/−30° in normal operation, or at least only exceed this range in exceptional cases, the toothed bevel gear can, as is particularly preferred, be in the form of toothed segments of a circle. This advantageously allows the drive connection to separate in the event of extreme servo-pendulum rudder pendulum swings in order to avoid the auxiliary rudder being overloaded, damaged or forced to make undesirable extreme swings. Moreover, this removes the need for maximum travel limiters, so the considerable forces that can occur at such stops are avoided and the self-steering system components affected can consequently be of lightweight design.

The arrangement of the rocker at the head of the auxiliary rudder shaft, especially on center, is particularly advantageous, as it makes the rocker particularly easily accessible for the engaging operation and considerably simplifies the design of the drive connection.

Expedient configurations of the subject matter of the invention, which in particular ensure high operating convenience, in particular also one-hand operation, and high mechanical strength, low-play connection, few components, high operating reliability and a particularly low risk of injury, may be found in the remaining claims.

The components mentioned above, claimed and described in the exemplary embodiment that are to be used according to the invention are not subject to any particular special requirements with respect to their dimensions, shape, choice of materials and technical design, so the selection criteria known in the respective area of application may be applied without restriction.

BRIEF DESCRIPTION OF THE DRAWINGS

Further details, features and advantages of the subject matter of the invention may be found in the following description of the appended drawing, in which, by way of example, a preferred embodiment of the self-steering system is shown and in which.

DESCRIPTION OF SPECIFIC PREFERRED EMBODIMENT

Figure 1:
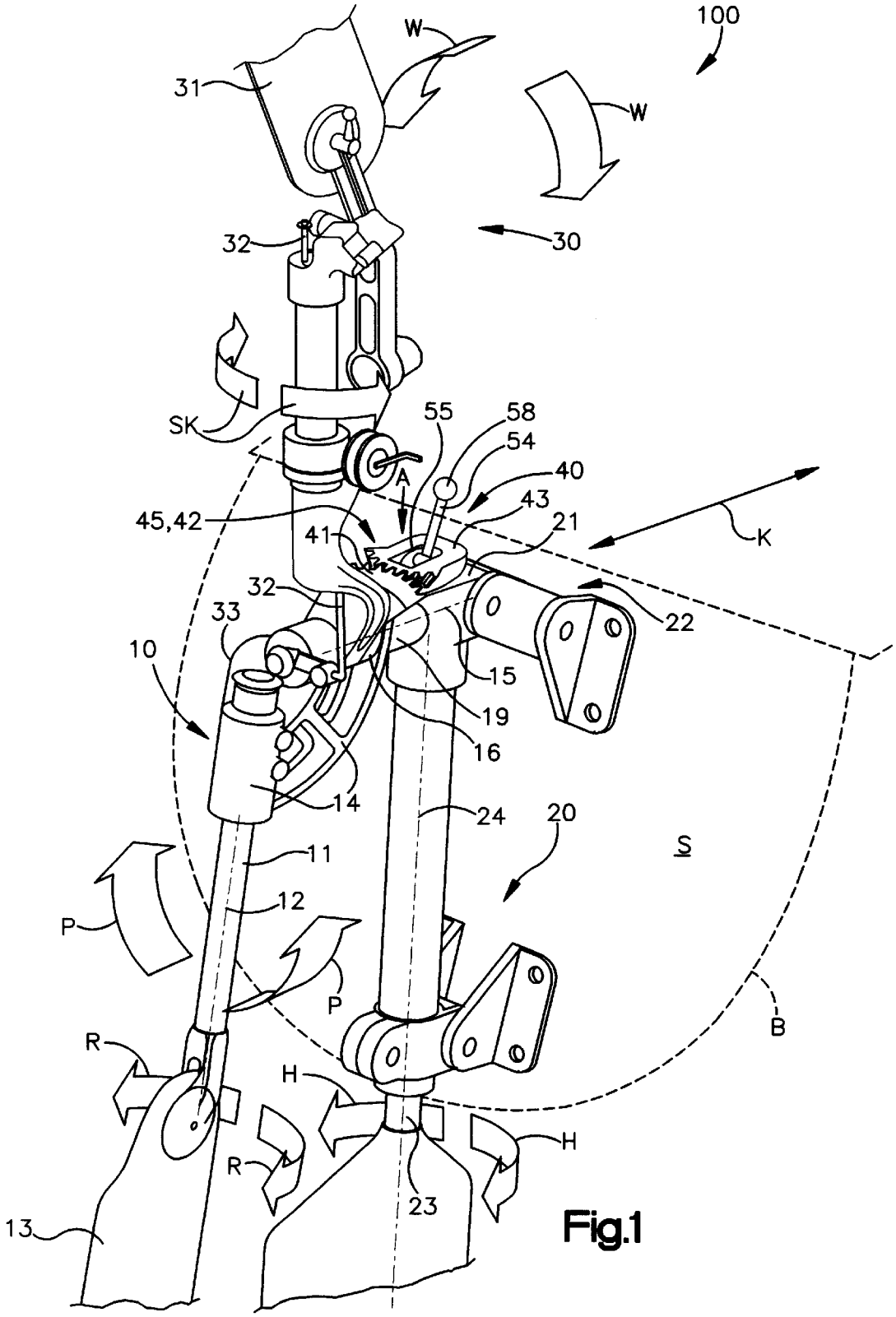
FIG. 1 shows a self-steering system in perspective view.
Figure 2:
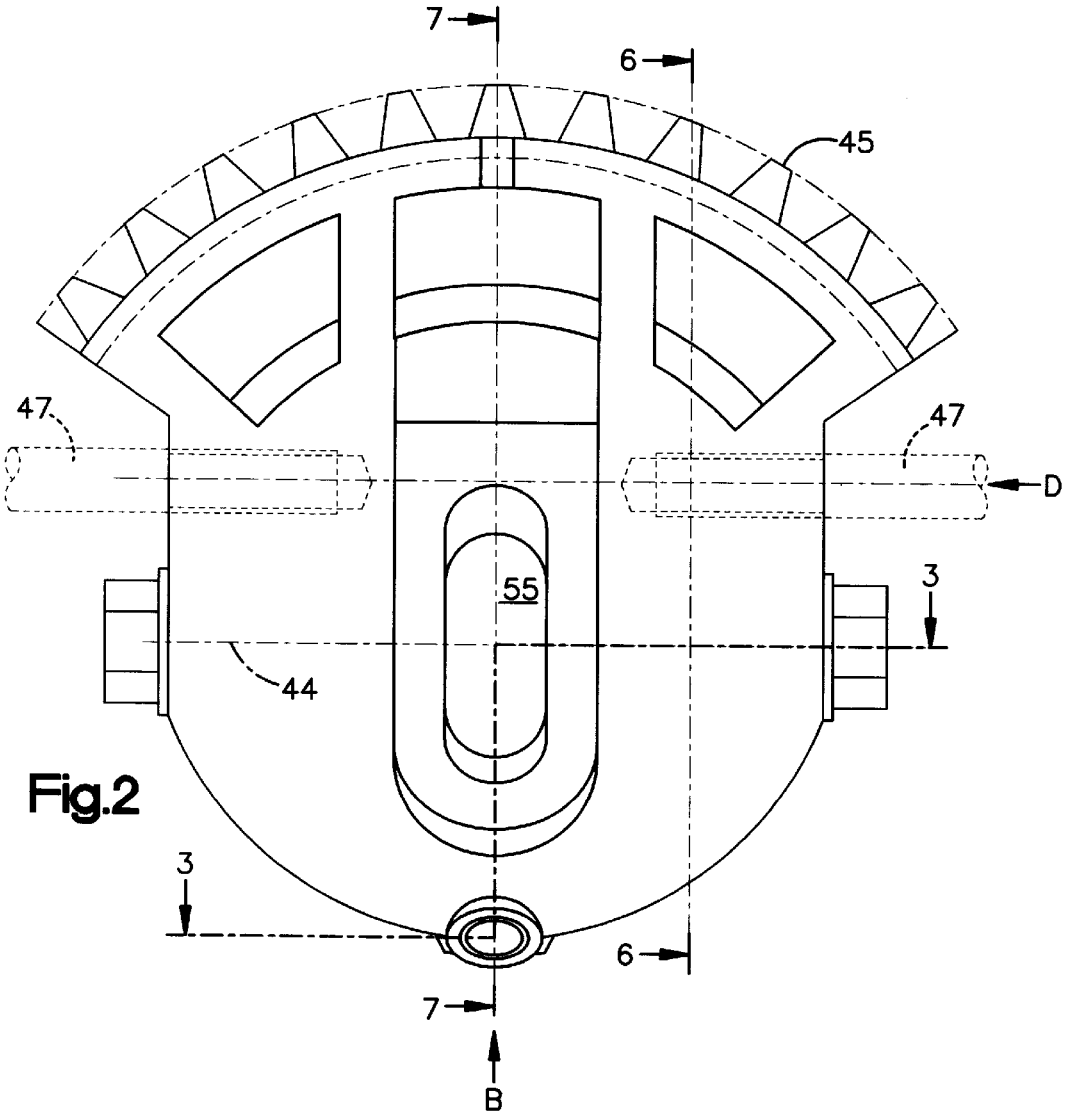
FIG. 2 shows a detailed view of the same self-steering system, specifically of the rocker, from above (view A in FIGS. 1 and 3)

FIG. 1 shows a self-steering system 100 having a servo-pendulum rudder 10, an auxiliary rudder 20, a positioning device 30 (transducer) with a windvane 31 and an engageable and disengageable drive connection 40 between the servo-pendulum rudder and the auxiliary rudder.

In the event of a deviation from the desired course, that is to say, in the case of the embodiment shown and to this extent preferred, a deviation of the actual angle of incidence from the prescribed angle of incidence SK between apparent wind direction and heading K of the boat B, the air flow streaming past flows against the windvane with a lateral component, thus causing the windvane to move out of its vertical neutral position shown in FIG. 1. This movement W of the windvane 31 is transmitted in a motion of rotation R of the servo-pendulum rudder shaft 11 about the latter's axis of rotation 12 to the servo-pendulum rudder blade 13, which is in the water, by means of a connecting rod 32 and a linkage protected by a housing 33. The servo-pendulum rudder blade is thus turned out of its neutral position, shown in FIG. 1, essentially parallel to the keel line K of the boat B and experiences a transverse force to the starboard or port side of the boat. The servo-pendulum rudder blade gives in response to this transverse force component because the servo-pendulum rudder arm 14 is mounted in a pendulum arm holder 19 such that it can pivot (P) about a horizontal or slightly inclined stationary pendulum axle in one bearing region 16 or in two bearing regions 16 spaced apart from each other. The pendulum axle is provided on a cantilever bolt 17 that is (indirectly) fastened rigidly to the boat.

Figure 8A:
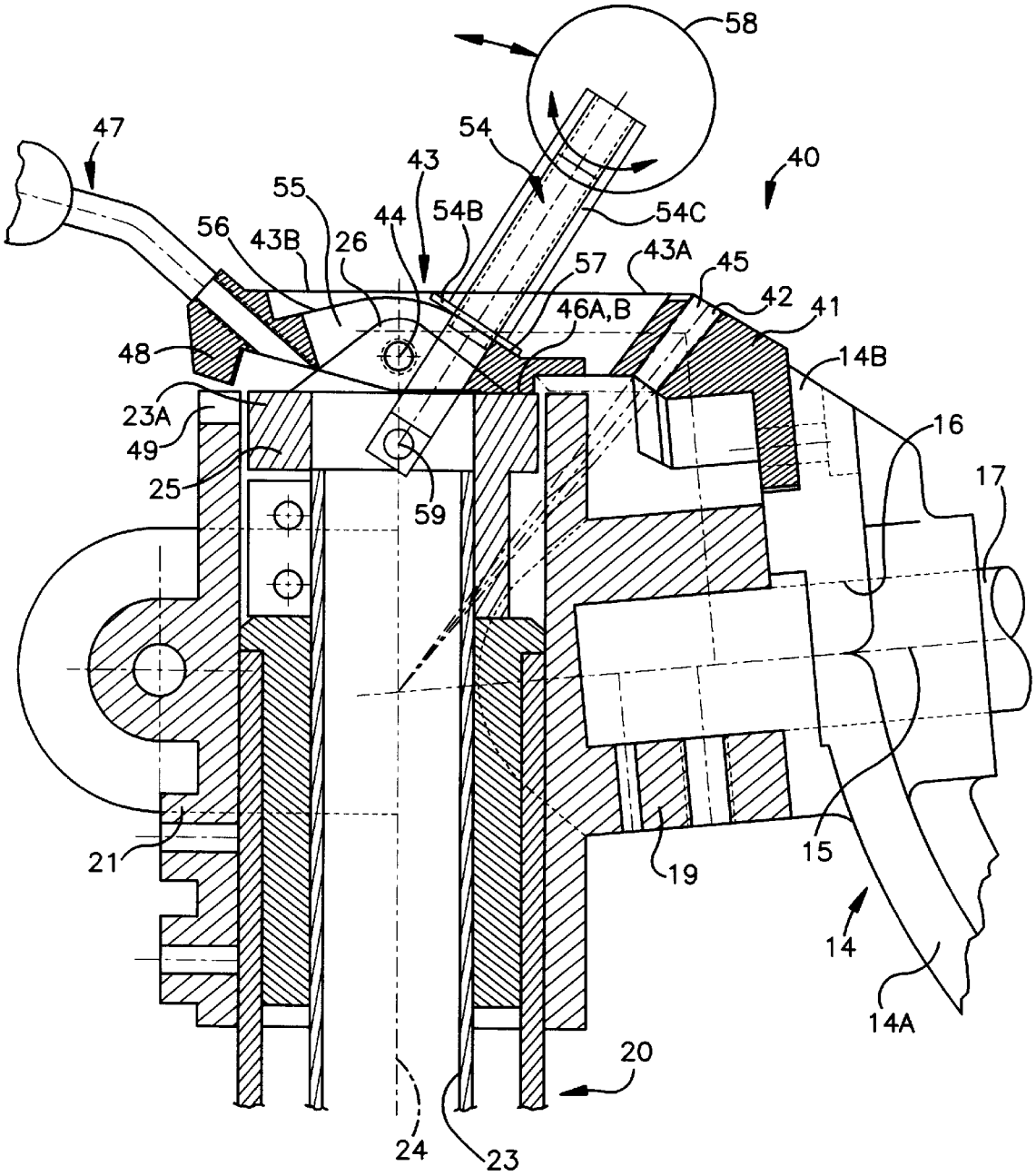
FIGS. 8A/B shows an enlarged detailed representation of the self-steering system according to FIG. 1 with the rocker in the engaged (FIG. 8A) and disengaged (FIG. 8B) states.

The pendulum arm 14 extends in two directions, the lower lever arm 14A taking the form of a quadrant segment in order to accommodate the servo-pendulum shaft bearing and the bearing on the cantilever bolt 17 at right angles to each other, and the second, upwardly angled lever arm 14B bearing the drive member of the drive connection 40 to the auxiliary rudder 20 at its upper free end (FIG. 8A/B). In the exemplary embodiment shown and to this extent preferred, this free end of the lever arm 14B has a 90° segment of a circular toothed bevel gear. This drive member 41 is advantageously fastened at the upper free end of the pendulum arm 14 in such a way that the summit of the toothed bevel gear 42 represents the uppermost end of the respective lever arm 14B. The teeth will mesh through pendulum swings covering an angular range of +/−30°.

Along the line of the imaginary extension of the cantilever bolt 17 to the stern S of the boat B can be found a supporting structure 21, which bears both the auxiliary rudder 20 and the cantilever bolt 17 and thus the servo-pendulum rudder 10 together with the positioning device 30, which is fastened to the cantilever bolt 17 in a rotationally-fixed manner. On its side remote from the cantilever bolt 17 the supporting structure 21 can be fastened by means of a mounting element 22 to the stern S of the respective boat B.

The supporting structure 21, directly or indirectly, allows the shaft 23 of the auxiliary rudder 20 to be mounted, free to rotate, in an approximately vertical position. The auxiliary rudder shaft 23 protruding at its upper end above the supporting structure 21 or ending at the latter has a rotatory force transmission component 25 in order to transmit the motion of rotation of a driven member 43 borne by said component 25 to the auxiliary rudder shaft 23 with axis of rotation 24. The self-steering system described thus far, with the exception of the toothed bevel gear 42, is known from the Applicant's EP-A1-0 243 942. There is thus no need to provide any further detail on the function of the individual elements, reference being made in this respect to EP-A1-0 243 942. As can be seen in detail in FIGS. 2 to 8A/B, the driven member 43 comprises a rocker pivotable through an angle of approximately 15 to 20° about a horizontal rocker axis 44 aligned approximately perpendicular to the keel line K of the boat B in the zero position. The rocker leg 43A facing aft with respect to the boat B bears at its extreme end a 90° segment of a toothed bevel gear 45 that meshes with the toothed bevel gear 42 of the drive member 41 in the working position of the rocker FIG. 8A. As can be seen in FIG. 8A, the toothed bevel gears 42 and 45 are perfectly engaged when the approximately horizontal underside (stop 46B) of the rocker leg 43A is resting with a stop face 46A on the head 23A of the auxiliary rudder shaft 23 such that the angle between them is minimal. This precisely defines the mechanical play of the toothed bevel gear 42, 45.

Figure 3:
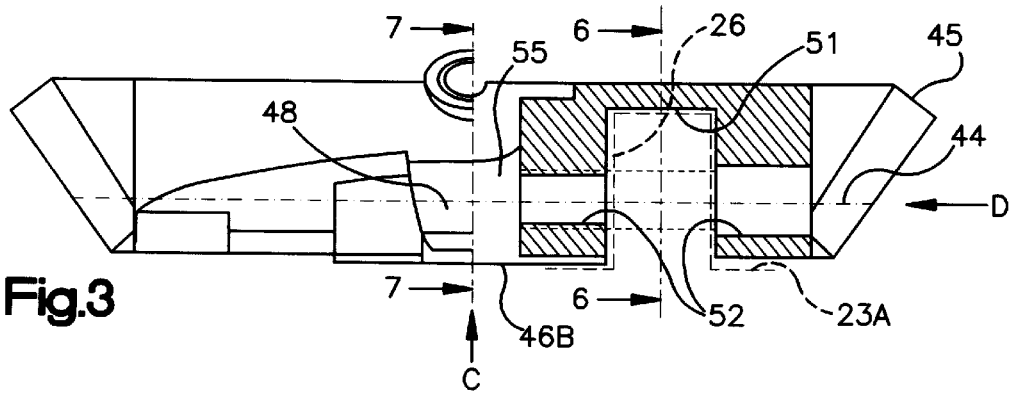
FIG. 3 shows a side view of the rocker according to FIG. 2 (view B), partially in section along the line III—III.
Figure 4:
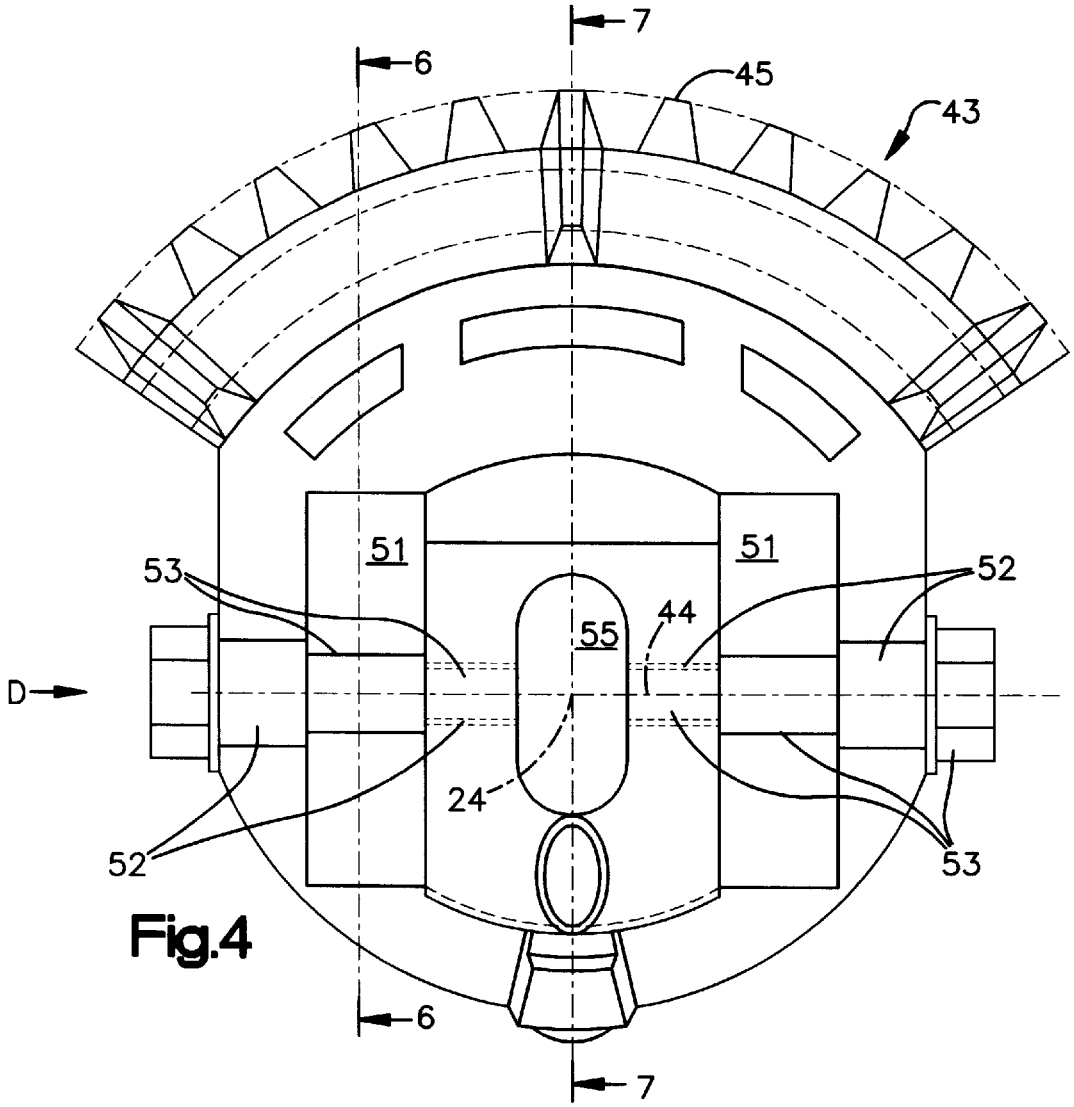
FIG. 4 shows a view of the rocker according to FIGS. 2 and 3 from below (view C in FIGS. 3 and 5)
Figure 5:
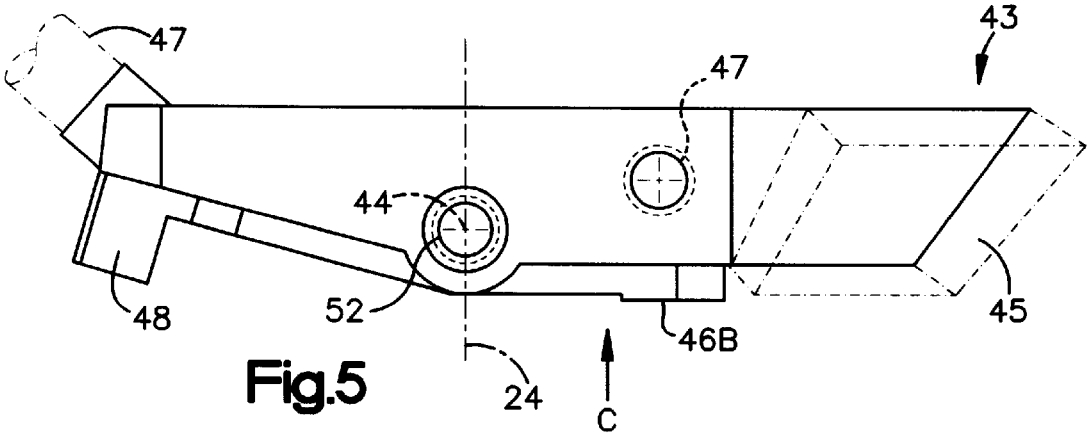
FIG. 5 shows a further side view of the rocker according to FIG. 2 (view D in FIGS. 2, 3 and 4)
Figure 6:
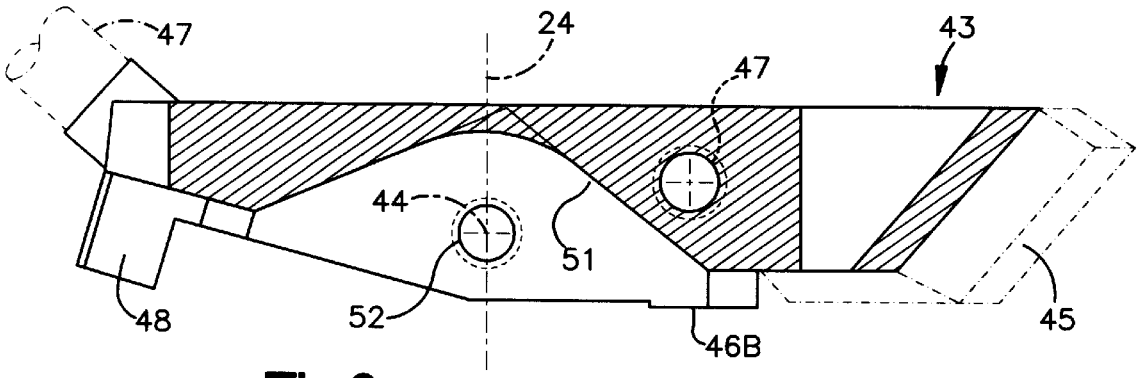
FIG. 6 shows a vertical section through the same rocker along the line VI—VI in FIGS. 2 and 3.
Figure 8B:
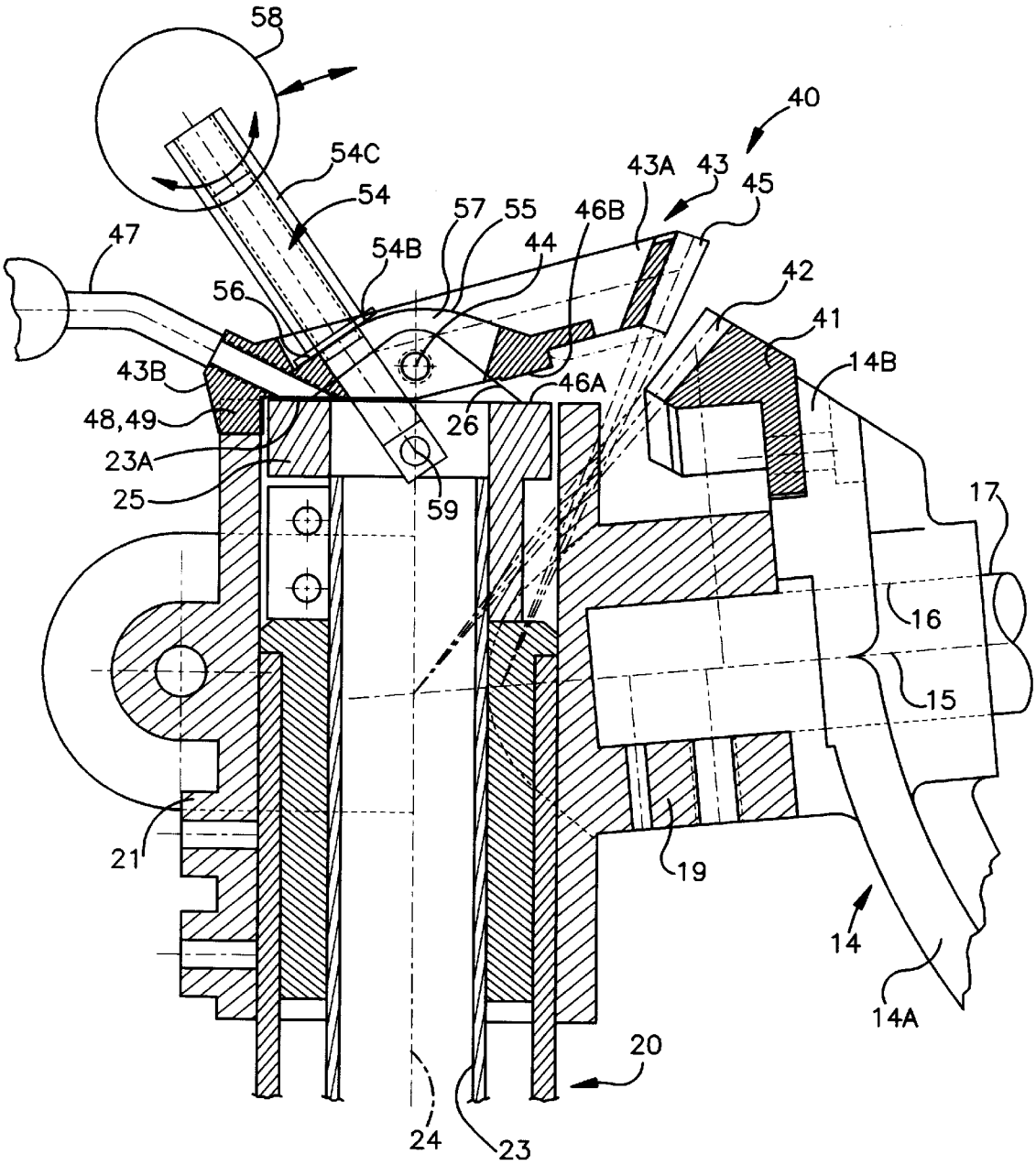

The rocker 43 is transferred to the resting position shown in FIG. 8B by pivoting it through approximately 15_ about the rocker axis 44 by means of an auxiliary steering tiller 47 that may optionally be capable of being fastened in different positions. The underside of the front rocker leg 43B rises to the left, i.e. forwards, in the working position and has a nose-like conical blocking element 48 formed, for example integrally, on its free end. Pivoting the rocker from the working position shown in FIGS. 1 and 8A into the resting position shown in FIG. 8B inserts the blocking element 48 into a conical recess 49, provided on the supporting structure 21, that serves as the blocking counter. This combination of blocking element and blocking counter is provided in case, as is preferred, the auxiliary rudder is simultaneously to be held blocked against rotation in its neutral position when the rocker is in the resting position, i.e. in the disengaged state. In this embodiment the rocker 43 must assume either the working position or the blocking position; no other states are possible. In the interests of compactness, transmission strength and minimum play, the rocker 43 is configured on its underside for a positive-locking connection with the head of the auxiliary rudder shaft 23 in such a way that two recesses 51 (FIGS. 3, 4 and 6) provided parallel to the keel line are incorporated in the underside of the rocker so as to give the longest possible double lever for transmitting the rotatory force. The recesses 51, which can be seen most clearly in FIGS. 3, 4 and 6, are shaped to conform to hump-like elements 26 (FIGS. 8A/B) provided at the head of the auxiliary rudder shaft 23 such that these humps are able to engage in the recess 51 with minimum play, but also such that the rocker 43 can be pivoted about these humps between the working position and the resting position.

To provide the best possible pivoting mounting the rocker 43 has a bore right through its width along the rocker axis 44 (FIGS. 3 and 4) such that swivel pins 53, which can be inserted and screwed fast into the bores 52 from both sides, pass through the recesses 51 such that they coincide with the humps on the head of the auxiliary rudder shaft (FIGS. 8A/B). For this purpose these humps are drilled through flush with the bores 52 so that the swivel pins 53 are accommodated to minimize play. The rocker 43 is thus fastened such that it cannot be lost, is free to pivot and can rotate together with the auxiliary rudder shaft 23 about the auxiliary rudder shaft axis.

One single retaining element is sufficient to ensure that the rocker 43 is effectively secured in its working position and in its resting position. This retaining element consists of a one-sided lever arm 54, which is fastened in a central position in the head of the auxiliary rudder shaft 23 and can pivot about an approximately horizontal lateral axis 59 (FIGS. 1 and 8A/B). This lever arm 54 passes through the central region of the rocker 43. Accordingly the rocker 43 has an elongated hole 55 extending approximately parallel to the keel line K with the auxiliary rudder 20 in the neutral position and being arranged such that the rocker axis 44 passes approximately through the center of the elongated hole 55. The swivel pins 53 thus end close to the wall of the elongated hole so that there is space in this region of the elongated hole for the lever arm 54 to pass through.

Stop surfaces 56 and 57, arranged inclined towards each other, are provided at the upper opening end of the elongated hole 55 to support a clamping piece 54B, which is mounted on the lever arm 54 such that it can be adjusted along the lever arm 54 using an actuator 58 (FIG. 1). As can be seen from FIG. 8A, the lever arm 54, which is limited in its pivoting movement by the elongated hole 55, is pivoted about its pivoting axis 59 into the rearmost position, to the right in the drawing, in the working position so that the clamping piece rests against the stop surface 57 and holds the rocker 43 in its working position. Releasing the clamping piece 54B by rotating the actuator 58 about the longitudinal axis of the lever arm 54 releases the rocker 43, allowing the lever arm 54 to be pivoted forwards (to the left in the drawing) about its pivot axis 59. In this position (FIG. 8*b*) the clamping piece 54B is moved back towards the rocker, using the actuator, so that the clamping piece comes to rest against the stop surface 56. Once the rocker has been pivoted into the resting position, the clamping piece is tightened fast against the stop surface 56 using the actuator, thus fixing the rocker arrangement in the resting position.

Figure 7:
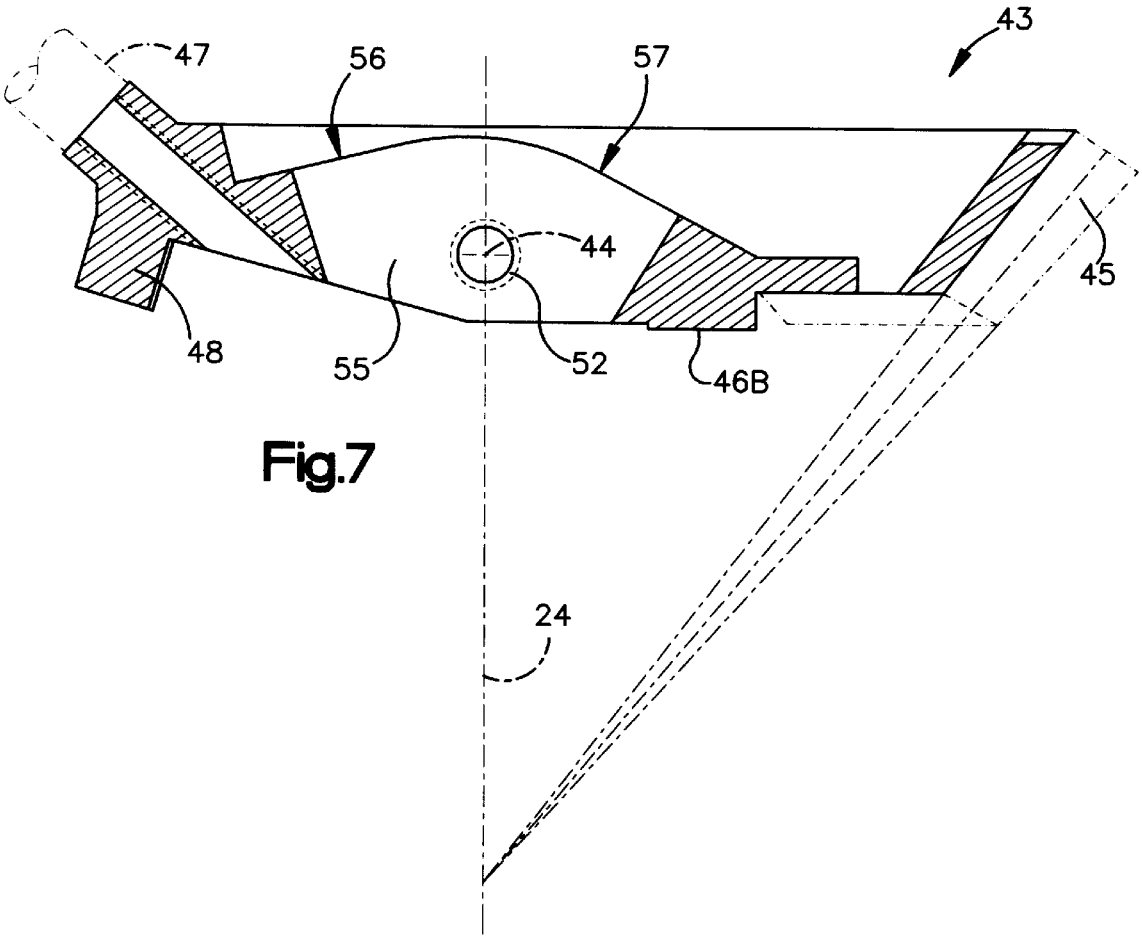
FIG. 7 shows a further vertical section through the same rocker along the line VII—VII in FIGS. 2 and 3.

As the pivoting axis 59 of the lever arm 54 is positioned with some spacing below the rocker axis 44, the lever arm 54 is always held in a defined position and thus cannot accidentally pivot out of the respective pivoting position if, for example, vibration causes the clamping element to release unintentionally (FIG. 7). The lever arm can also serve as a remote control for pivoting the rocker when the clamping element is released.

| Reference numbers | |
|---|---|
| 10 | servo-pendulum rudder |
| 11 | servo-pendulum rudder shaft |
| 12 | axis of rotation |
| 13 | servo-pendulum rudder blade |
| 14 | pendulum arm |
| 15 | pendulum axle |
| 16 | bearing region |
| 17 | cantilever bolt |
| 19 | pendulum arm holder |
| 20 | auxiliary rudder |
| 21 | supporting structure |
| 22 | mounting element |
| 23 | auxiliary rudder shaft |
| 23A | head |
| 24 | axis of rotation |
| 25 | rotatory force transmission component |
| 26 | hump |
| 30 | positioning device (transducer) |
| 31 | windvane |
| 32 | connecting rod |
| 33 | housing |
| 40 | drive connection |
| 41 | drive member |
| 42 | toothed bevel gear |
| 43 | driven member |
| 43A | rocker leg |
| 43B | rocker leg |
| 44 | rocker axis |
| 45 | toothed bevel gear |
| 46A | stop surface |
| 46B | stop surface |
| 47 | auxiliary steering tiller |
| 48 | blocking element |
| 49 | blocking counter |
| 51 | recesses |
| 52 | bores |
| 53 | swivel bolts |
| 54 | lever arm |
| 54A | lateral axis |
| 54B | clamping piece |
| 54C | screw clamp sleeve |
| 55 | elongated hole |
| 56 | stop surfaces |

-continued

| Reference numbers | |
|---|---|
| 57 | stop surfaces |
| 58 | actuator |
| 59 | pivoting axis |
| 100 | self-steering system |
| A | view |
| B | view |
| C | view |
| D | view |
| K | keel line |
| B | boat |
| w | windvane pivot |
| R | rotatory movement |
| S | stern |
| H | auxiliary rudder movement |
| P | pendulum movement |
| SK | desired course setting |

What is claimed is:

1. A steering system for a boat, said steering system comprising:

an auxiliary rudder which is adapted to be connected with the boat, said auxiliary rudder adapted to being rotatable relative to the boat to effect changes in course of the boat;

a servo-pendulum rudder which is adapted to be connected with the boat and is adapted to be rotatable relative to the boat about a first axis, said servo-pendulum rudder being adapted to be pivotal transversely to a keel line of the boat about a second axis by water flowing past the boat upon rotation of said servo-pendulum rudder about the first axis;

a positioning device connected with said servo-pendulum rudder, said positioning device being operable to rotate said servo-pendulum rudder about the first axis upon deviation of the boat from a desired course; and a drive connection between said servo-pendulum rudder and said auxiliary rudder, said drive connection includes a drive member and a driven member, one of said drive and driven members being movable relative to the other of said drive and driven members between an engaged condition and a disengaged condition, said drive and driven members having arcuate arrays of teeth which are disposed in meshing engagement to enable force to be transmitted between said drive and driven members when said one of said drive and driven members is in the engaged condition, said arcuate arrays of teeth on said drive and driven members being spaced apart to prevent force from being transmitted between said drive and driven members when said one of said drive and driven members is in the disengaged condition.

2. A steering system as set forth in claim 1 further a retainer which is engageable with said one of said drive and driven members to hold said one of said drive and driven members in the engaged condition.

3. A steering system as set forth in claim 2 wherein said retainer is engageable with said one of said drive and driven members to hold said one of said drive and driven members in the disengaged condition.

4. A steering system as set forth in claim 1 further including a retainer which is engagable with said one of said drive and driven members to hold said one of said drive and driven members in the disengaged condition.

5. A steering system as set forth in claim 1 wherein said arcuate arrays of teeth on said drive and driven members are arcuate arrays of bevel gear teeth, each of said arcuate arrays of bevel gear teeth forms a portion of a circle.

6. A steering system as set forth in claim 1 wherein said one of said drive and driven members is pivotal between the engaged and disengaged conditions about an axis which extends through a portion of said one of said drive and driven members.

7. A steering system as set forth in claim 1 wherein said auxiliary rudder includes a shaft which is rotatable about an axis which extends through said one of said drive and driven members.

8. A steering system as set forth in claim 7 wherein said auxiliary rudder is rotatable about a third axis, said one of said drive and driven members being pivotal between the engaged and disengaged conditions about a fourth axis which extends transverse to said third axis about which said auxiliary rudder is rotatable.

9. A steering system as set forth in claim 1 wherein said auxiliary rudder includes a rotatable shaft, said one of said drive and driven members being connected with said shaft of said auxiliary rudder for rotation therewith when said one of said drive and driven members is in the engaged condition and in the disengaged condition.

10. A steering system as set forth in claim 1 wherein said one of said drive and driven members is connected with said auxiliary rudder for rotation therewith, said steering system further includes an auxiliary tiller handle which is connected with said one of said drive and driven members to transmit force which is effective to rotate said auxiliary rudder.

11. A steering system as set forth in claim 1 further including a handle connected with said one of said drive and driven members to transmit force which effects movement of said one of said drive and driven members between the engaged and disengaged conditions.

12. A steering system as set forth in claim 1 further a handle which is connected with said auxiliary rudder and is movable relative to said auxiliary rudder to move said one of said drive and driven members between the engaged and disengaged conditions.

13. A steering system as set forth in claim 1 wherein said positioning device includes a wind vane which is connected with said auxiliary rudder through said drive and driven members.

14. A steering system as set forth in claim 1 further including a manually engagable locking member which is movable relative to said one of said drive and driven members between a first position in which said one of said drive and driven members is held in the engaged condition and a second position in which said one of said drive and driven members is held in the disengaged condition.

15. A steering system as set forth in claim 1 wherein said one of said drive and driven members is pivotal between the engaged and disengaged conditions about an axis which extends transverse to said first and third axes.

16. A steering system for a boat, said steering system comprising:

an auxiliary rudder which is adapted to be connected with the boat and is adapted to be rotatable about a first axis relative to the boat to effect changes in course of the boat;

a servo-pendulum rudder which is adapted to be connected with the boat and is adapted to be rotatable about a second axis relative to the boat, said servo-pendulum rudder adapted to being pivotal relative to the boat in a direction transverse to a keel line of the boat about a third axis which extends transverse to the first and second axes by water flowing past the boat upon rotation of said servo-pendulum rudder about said second axis;

a positioning device connected with said servo-pendulum rudder, said positioning device being operable to rotate said servo-pendulum rudder about the second axis upon deviation of the boat from a desired course; and a drive connection between said servo-pendulum rudder and said auxiliary rudder, said drive connection includes a drive member which is rotatable about said third axis with said servo-pendulum rudder and a driven member which is rotatable about said axis with said auxiliary rudder, one of said drive and driven members being pivotal about a fourth axis which extends transverse to said first and second axes to effect movement of said one of said drive and driven members between an engaged condition and a disengaged condition, said drive connection being effective to transmit force between said servo-pendulum rudder and said auxiliary rudder when said one of said drive and driven members is in the engaged condition, said drive connection being ineffective to transmit force between said servo-pendulum rudder and said auxiliary rudder when said one of said drive and driven members is in the disengaged condition.

17. A steering system as set forth in claim 16 further including a handle which is manually pivotal relative to said drive and driven members between a first position in which said one of drive and driven members is held in the engaged condition and a second position in which said one of said drive and driven members is held in the disengaged condition.

18. A steering system as set forth in claim 16 said fourth axis extends through a portion of said on of said drive and driven members.

19. A steering system as set forth in claim 16 wherein said first axis extends through a portion of said one of said drive and driven members.

20. A steering system as set forth in claim 16 further including a first arcuate array of teeth on said drive member and a second arcuate array of teeth on said driven member, said first and second arcuate arrays of teeth being disposed in meshing engagement when said one of said drive and driven members is in the engaged condition, said first and second arcuate arrays of teeth being out of meshing engagement when said one of said drive and driven members is in the disengaged condition.

* * * * *

UNITED STATES PATENT AND TRADEMARK OFFICE

CERTIFICATE OF CORRECTION

PATENT NO. : 6,098,561
DATED : August 8, 2000
INVENTOR(S) : Peter Forthmann

It is certified that error appears in the above-indentified patent and that said Letters Patent is hereby corrected as shown below:

Column 7, line 28, after "is" delete "adapted to be"

Column 8, line 60, after "is" delete "adapted to be"

Signed and Sealed this

First Day of May, 2001

*Attest:*

Nicholas P. Godici

NICHOLAS P. GODICI

*Attesting Officer*

*Acting Director of the United States Patent and Trademark Office*